United States Patent [19]

Bauer et al.

[11] Patent Number: 4,781,158

[45] Date of Patent: Nov. 1, 1988

[54] CYLINDER HEAD

[75] Inventors: Lothar Bauer, Cologne; Ernst-Siegfried Hartmann, Overath, both of Fed. Rep. of Germany

[73] Assignee: Kloeckner-Humboldt-Deutz AG, Fed. Rep. of Germany

[21] Appl. No.: 942,358

[22] Filed: Dec. 15, 1986

[30] Foreign Application Priority Data

Dec. 20, 1985 [DE] Fed. Rep. of Germany ..... 3545333

[51] Int. Cl.[4] ..... F22B 5/00

[52] U.S. Cl. ..... 123/193 CH; 123/41.69

[58] Field of Search ..... 123/193 H, 193 CH, 41.69

[56] References Cited

U.S. PATENT DOCUMENTS 3,117,565 1/1964 Bottger ..... 123/41.69
4,346,676 8/1982 Tyner ..... 123/41.74

FOREIGN PATENT DOCUMENTS 2227120 12/1973 Fed. Rep. of Germany ... 123/41.69
341256 1/1931 United Kingdom ..... 123/41.69

*Primary Examiner*—Henry A. Bennet
*Attorney, Agent, or Firm*—Charles L. Schwab

[57] ABSTRACT

An air-cooled block cylinder head adapted for mounting on an open-deck cylinder casing of an internal combustion engine. In order to maintain a tight seal of the cylinder head to the cylinder casing, the combustion chamber floor of the cylinder head is designed to be deflected in a manner that does not adversely affect the sealing of the cylinder head to the cylinder casing. This is achieved by designing the cooling chamber side of the cylinder head floor with a gradually changing floor wall thickness in the area directly above the cylinder combustion chamber. In the preferred designs, the combustion chamber floor is designed to be concave or convex. The cylinder head also includes features for effectively cooling the combustion chamber floor and for isolating the exhaust conduit.

11 Claims, 6 Drawing Sheets

CYLINDER HEAD

TECHNICAL FIELD

This invention relates to an air-cooled cylinder head for an internal combustion engine which has an exhaust valve and an intake valve.

PRIOR ART STATEMENT

A cylinder head shown in the Federal Republic of Germany patent DE-PS No. 24 59 186 includes a combustion chamber floor which has parallel surfaces on its cooling chamber and combustion chamber sides. In such a combustion chamber floor of constant thickness, the resistance to deflection and deformation of the floor is not proportional to the combustion pressures which are not uniform across the combustion chamber diameter. Thus a combustion chamber floor of uniform thickness is not capable of satisfactorily resisting deformation which are caused by the varying and nonuniform gas pressures acting on the floor. Especially in engines using "open deck cylinder casings", it is difficult to achieve an effective seal between the cylinder head and the cylinder casing or cylinder pipe. In addition, the rate of heat loss through the combustion chamber floor of the cylinder head is equal at all points because of its constant thickness. Thus a combustion chamber floor of uniform thickness cannot conduct heat in a manner matching the various temperatures in the combustion chamber.

OBJECTS AND BRIEF SUMMARY OF THE INVENTION

It is an object of this invention to provide an air-cooled cylinder head for an internal combustion engine with an "open deck cylinder casing" which is sufficiently rigid to ensure a tight seal with the cylinder casing and at the same time provide effective cooling of the cylinder head zones which are highly stressed by the pressures of the hot combustion gases in the cylinder.

In the air-cooled cylinder head of this invention, the combustion chamber floor is designed with a wall thickness which varies gradually from its central part to its radially outer edge, thereby providing structure resisting deformation in opposition to the corresponding forces caused by the nonuniform pressures across the combustion chamber diameter. Because of this optimized resistance to combustion forces against the combustion chamber floor, the head is not adversely deformed and it is possible to achieve a tight sealing of the head with the combustion chamber and the cooling chamber which surrounds the cylinder head. In addition, because of the varying thickness of the combustion chamber floor, it is possible to effectively cool the thermally highly stressed zones of the cylinder head, such as, for example, the areas of the injection nozzle and the exhaust valve.

In the preferred embodiment of the invention, the cooling chamber side of the combustion chamber floor is concave.

It is also possible to provide a convex configuration for the cooling air side of the combustion chamber floor of the cylinder head. The convex shaped floor surface may be preferred in a block cylinder head having an upper deck since the expense of molding and casting in the manufacture of the cylinder head blank is reduced. It is desirable to provide an annular rim or ridge on the cooling chamber side and surrounding the combustion chamber floor covering the combustion chamber of the cylinder on which the cylinder head rests. The additional floor thickness afforded by the annular ridge contributes to an extremely deformation-free combustion chamber floor in this area which is important for maintaining an effective seal between the head and the cylinder casing. Preferably, the walls of the exhaust conduit are not connected to the intake conduit and are not connected to the combustion chamber floor except at the exhaust port for the exhaust valve. The annular ridge extends beneath, but does not contact, the walls defining the air intake and exhaust conduits. Thus good thermal isolation is provided for the air inlet and exhaust conduits, which are stressed very differently because of the temperature difference between the intake air and the exhaust gases.

An annular groove may be provided in the combustion chamber side of the combustion chamber floor of the cylinder head in the area of the annular ridge. This annular groove may be flushed with cooling air via bores or channels which extend radially inward and are sealed with respect to the cylinder casing in a fluid-tight and gas-tight manner. It may be advantageous to connect the annular groove With a liquid-cooled cylinder casing chamber via openings in the cylinder head gasket. With such a design, the before-mentioned bores in the cylinder head for flushing the annular groove with cooling air are deleted. Both designs share the advantage of intensive cooling of the combustion chamber ridge via the annular groove.

Heat conduction may be improved by adding fins on the cooling chamber side of the combustion chamber floor which taper into the combustion chamber annular ridge. The fins increase the effective heat transfer surface on the head contacted by the cooling air and serve to direct or guide the cooling air flowing through the cylinder head to those areas which especially need to be cooled, such as, for example, the walls of the exhaust conduit and the injection nozzle seat.

A cylinder head bolt may be disposed between the air intake conduit and the exhaust conduit with its head surface supported on the cylinder head at the upper end of a vertically disposed cylindrical opening in the head. The walls defining the cylindrical opening are common in part to the walls defining the air intake conduit and are spaced from, and thus isolated from, the walls defining the exhaust conduit. An intermediate part of the cylindrical opening for the head bolt in the area of the air intake conduit is crescent-shaped in section. Thus the cylinder head bolt disposed between the air intake and exhaust conduits is isolated from the severe thermal fluctuations and resulting thermal expansion generated by the exhaust conduit.

In order to thermally isolate the exhaust conduit from the surrounding areas of the cylinder head, the walls defining the exhaust conduit are spaced from the adjacent cylinder head partitions and is thus completely bathed by the flow of cooling air which flows through the cylinder head. As an additional measure to improve the cooling of the combustion chamber floor, a cooling air guide fin may extend downwardly from the upper deck of the head so as to direct a part of the stream of cooling air which flows through the cylinder head downwardly toward the combustion chamber floor. In this way, the cooling of the thermally endangered combustion chamber floor is further intensified.

The cooling air is guided out of the cylinder head on one lateral side of the cylinder head, at which the intake air and exhaust conduits terminate. The cylinder head side wall at such one lateral side may include openings of predetermined size which serve to regulate the flow of cooling air in a manner ensuring adequate flow around the exhaust conduit. An air intake and exhaust manifold gasket with appropriate openings may be provided at the one side of the head to achieve the desired distribution of air flow in the area of the exhaust conduit.

A slot may be provided in the combustion chamber side of the combustion chamber floor between the individual cylinders and above a cylinder casing cooling jacket chamber. The slot is either supplied with cooling air by bores leading to the cooling air chamber of the cylinder head or are connected with the liquid-cooled cylinder jacket chamber by means of appropriate openings in the cylinder head gasket. These features contribute to improved cooling of the cylinder head and simultaneously reduce mechanical stress in the area of the cylinder head floor, since the slot reduces and/or slows the flow of heat between adjacent sections of the cylinder head on opposite sides of the slot.

A liquid passageway may be formed along the side of the cylinder head to which cooling air is discharged. This liquid passageway may be located at the height of the valve spring seats and may extend along the entire length of the cylinder head. This passageway is located in the upper deck of the head in such a way that it is cooled by the cooling air flowing laterally through the cylinder head and is not connected to the walls of the exhaust conduit. Thus the cooling air is free to flow between the intake and exhaust conduits and around the connecting flange of the exhaust passage conduit. The liquid passageway may be utilized advantageously as a lubricant passage for lubricating the valve drive mechanism and simultaneously to transfer heat.

The cylinder head of this invention is so designed that it may be made of gray cast iron which has proven to be a good material for cylinder heads. Such a cylinder head may be manufactured economically and will possess proper mechanical and thermal characteristics for an air-cooled engine cylinder head.

BRIEF DESCRIPTION OF THE DRAWINGS

Various embodiments of the invention are shown in the drawings, in which.

DETAILED DESCRIPTION OF THE DRAWINGS

Figure 1:
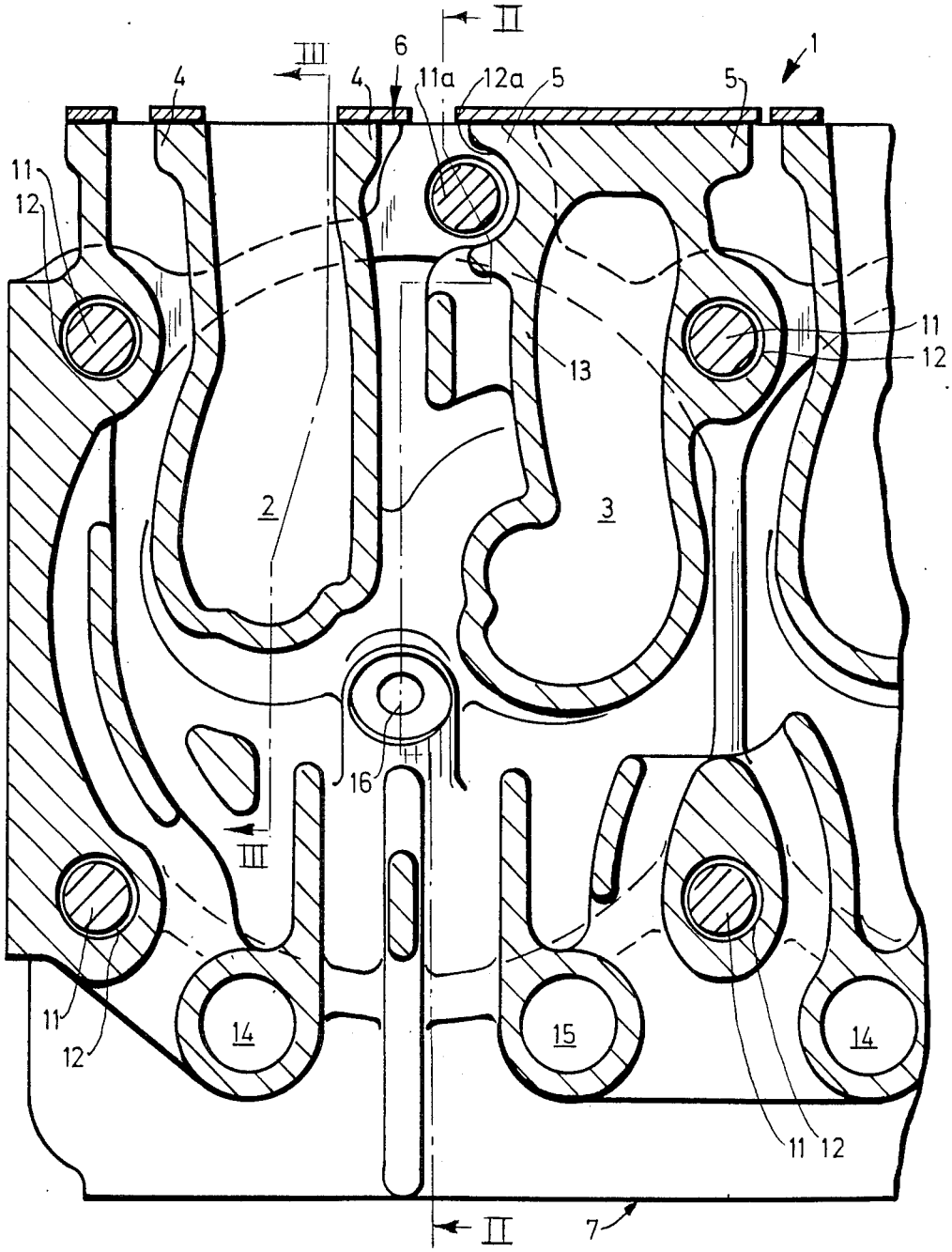
FIG. 1 is a horizontal section through a cylinder head parallel to its combustion chamber side.
Figure 2:
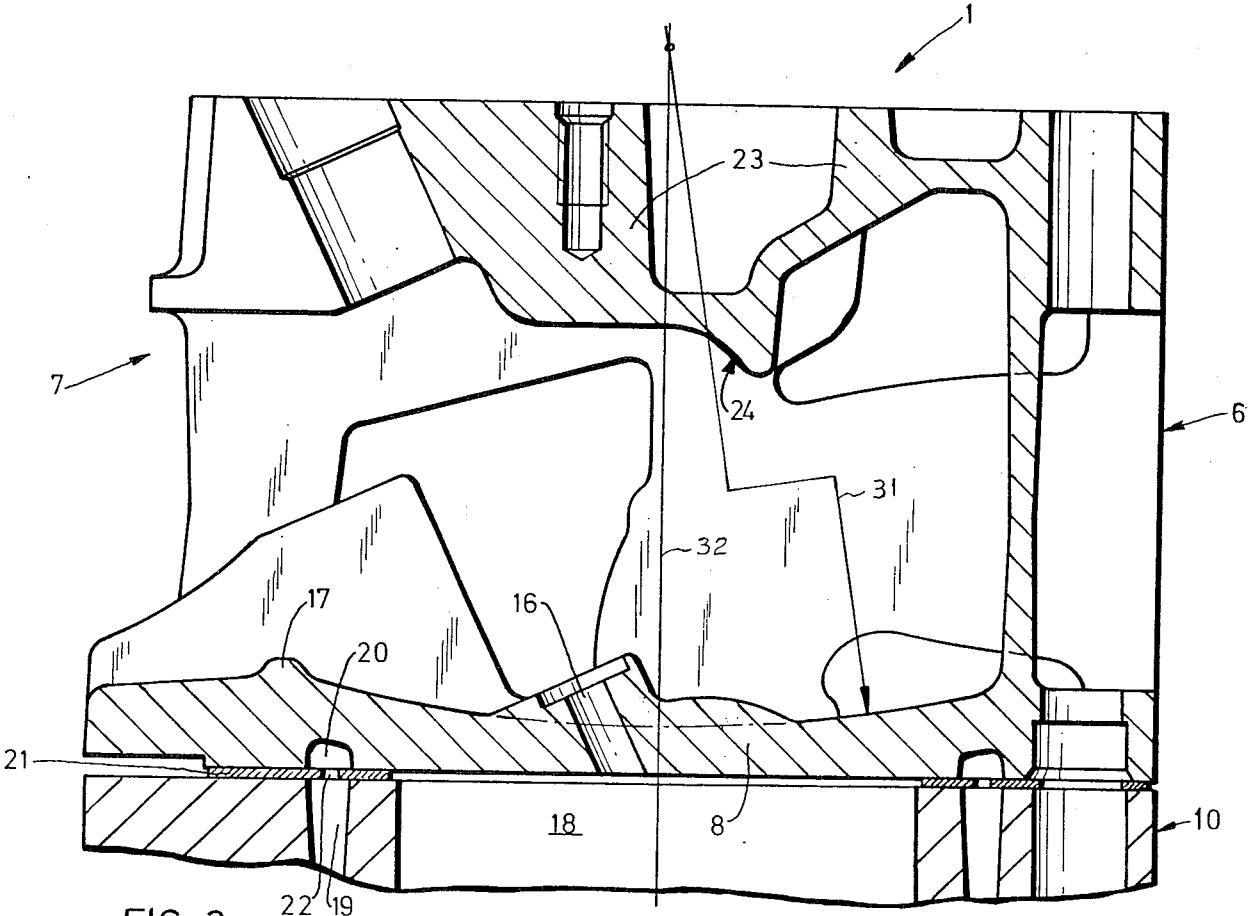
FIG. 2 is a view taken along the line II—II in FIG. 1.

Referring to FIGS. 1 and 2, an air-cooled cylinder head 1, which is designed as a gray cast iron block cylinder head for a plurality of "in-line" cylinders which are arranged next to each other, includes walls defining an air intake passage or conduit 3 and an exhaust passage or conduit 2 operatively connected with the air intake and exhaust valve ports for the associated cylinder. Exhaust conduit 2 and air intake conduit 3 terminate in manifold connector flanges 4 and 5, which are disposed at a lateral side 6 of the cylinder head 1. The cylinder head 1 is bathed with cooling air flowing laterally which is transverse to the longitudinal direction of the engine, whereby the cooling air enters along the longitudinal side 7, which is laterally opposite the longitudinally extending side 6 at which the connector joining flanges 4, 5 of the exhaust and intake conduits 23 are located. The cooling air which enters cylinder head 1 is directed towards all areas of the cylinder head by cooling fins. In the process, the zones of cylinder head 1 which are subject to great heat are, for the most part, isolated or detached from the adjacent cylinder head partition components. For instance, the exhaust gas conduit 2 is connected with cylinder head 1 only at the combustion chamber floor 8 and at the exhaust valve guide bore 9, and is otherwise isolated within cylinder head 1. The cylinder head 1 is secured by cylinder head bolts 11 to a cylinder casing 10 which is of the "open-deck" type. The cylinder head bolts 11 are arranged in zones of cylinder head 1 which are minimally burdened thermally. It will be noted that none of the cylinder head bolt passageways 12 are connected to the exhaust gas conduit 2. A cylinder head bolt **11*a* which is disposed between the air intake conduit 3 and the exhaust conduit 2 passes through a head bolt pipe 12*a* whose intermediate part is crescent-shaped in section and serves as a support wall for the upper deck 23. The crescent-shaped pipe 12*a* is formed in the side wall 13 of the intake conduit 3, which wall is in longitudinally confronting but spaced relation to the exhaust conduit 2**.

Push rod openings 14 and 15 are arranged along the longitudinally extending air inlet side of the cylinder head 1. An injection nozzle, not shown, is disposed (when installed) in the center of cylinder head 1 and the corresponding injection opening. 16 in the floor 8 is tilted in an obtuse angle relative to the bottom side of the combustion chamber floor 8.

As shown in FIG. 2, the upper cooling air side of the combustion chamber floor 8 is dish-shaped or concave with a spherical radius indicated by the arrow 31 whose center lies on the cylinder center line 32. The radially outer edge of the combustion chamber floor 8 is rimmed by an annular ridge 17. The upward bulging annular ridge 17 surrounds the floor 8 covering the end of the cylinder 18 and is disposed radially outward of a cylinder cooling jacket chamber 19 in the cylinder casing 10.

Above cylinder cooling jacket chamber 19, a confronting annular groove 20 is formed in the combustion chamber floor 8 of cylinder head 1. The annular channel or groove 20 is connected via openings 22 in the cylinder head gasket 21 with the cylinder cooling jacket chamber 19. Thus the cooling liquid, which can be an arbitrarily chosen coolant such as water or oil, flows into the annular groove 20 and provides intensive cooling of the combustion chamber floor 8 of the cylinder head 1.

In addition, in the support area under cylinder head top plate or upper deck 23, a depending cooling fin 24 is provided which directs the cooling air which enters from the longitudinal side 7 downwardly toward the combustion chamber floor 8 of the cylinder head 1.

Figure 4:
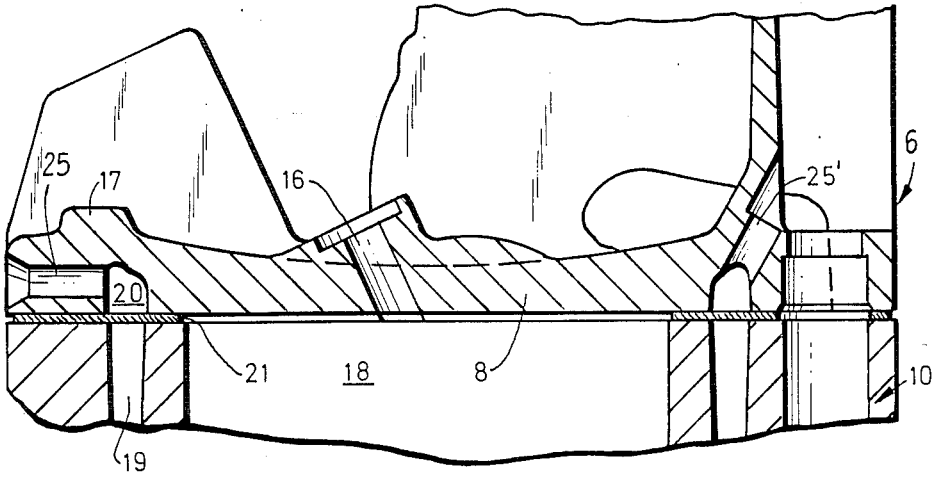
FIG. 4 is a view similar to FIG. 2 but showing a modified form of the invention.

In FIG. 4, the annular groove 20 is cooled differently. The annular groove 20 in this embodiment is separated from the cylinder cooling jacket chamber 19 by a gas-tight and liquid-tight cylinder head gasket 21 in the area of the annular groove. Instead of being cooled by liquid, the annular groove 20 in the FIG. 4 embodiment is cooled by cooling air which enters and leaves the annular groove 20 by means of bores 25, 25' at opposite lateral sides of cylinder head 1.

Figure 3:
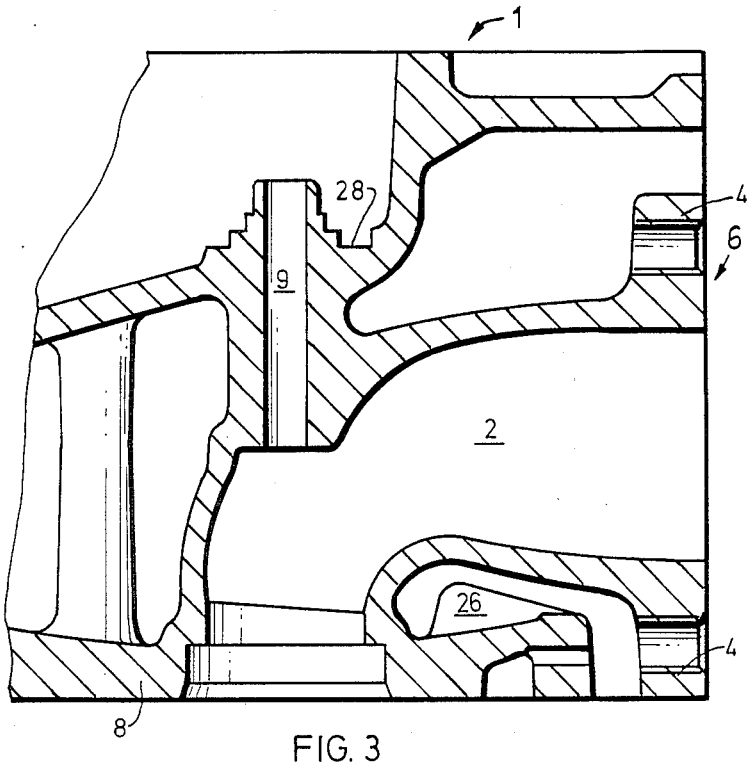
FIG. 3 is a view taken along the line III—III in FIG. 1.

FIG. 3 shows that the exhaust conduit 2 is completely detached from the other partitions or walls of cylinder head 1, except for the necessary connections with the exhaust valve port in the combustion chamber floor 8 and with the upper deck 23 by the wall structure defining the outlet valve guide bore 9. In addition, upright and laterally extending cooling fins 26 are disposed along the combustion chamber floor 8, which taper into the bulge-shaped annular ridge 17.

Figure 5:
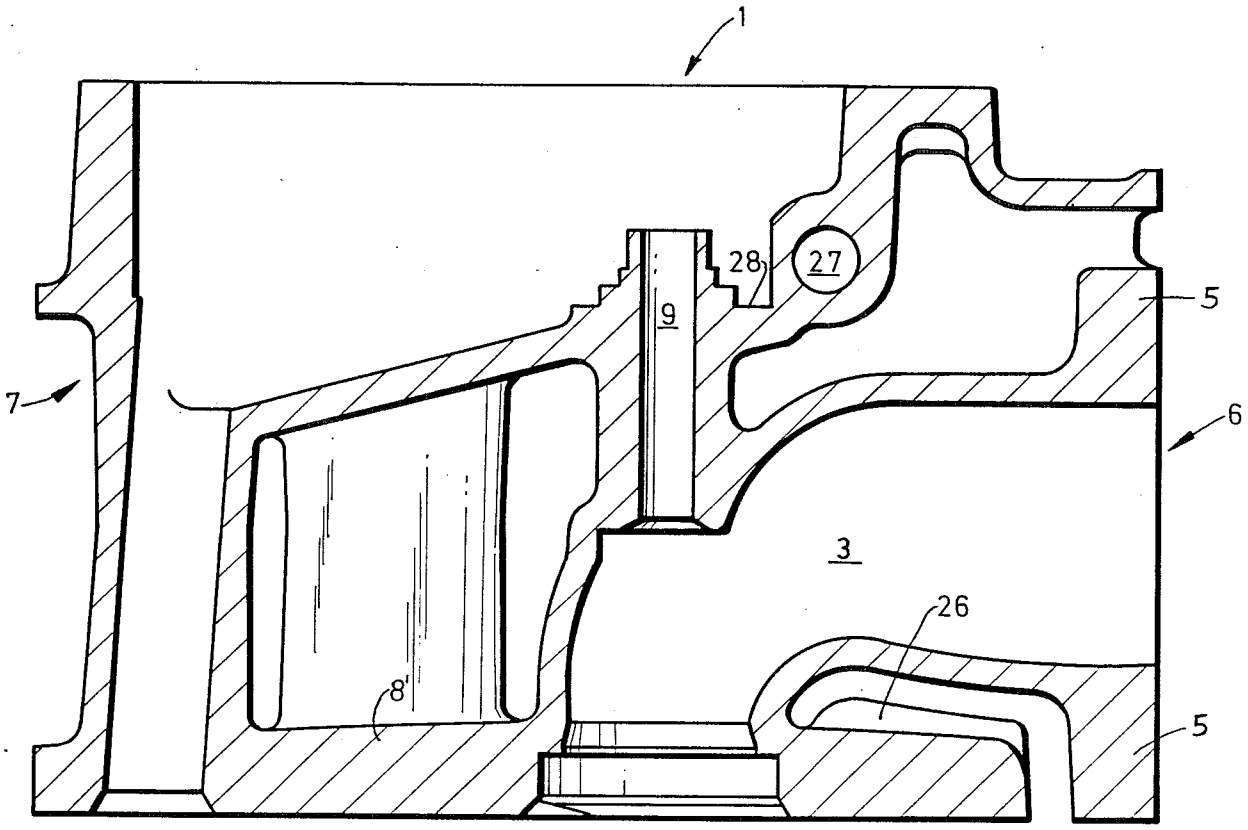
FIG. 5 is a vertical section through a cylinder head showing an alternate form of the invention.

In the embodiment of FIG. 5, the upper or cooling air side of the combustion chamber floor 8' of the cylinder head 1 is convex rather than concave and the floor 8' is of gradually decreasing thickness from its central part to its radially outer edge. The embodiment of FIG. 5 also includes a liquid passage 27 in the upper deck 23 at the height of the valve spring seats 28 which extends the entire longitudinal length of cylinder head 1. This liquid passageway 27 may be supplied with oil which is used simultaneously to lubricate the valve operating mechanism, not shown, within the cylinder head and to transfer heat through its exposure to the cooling air and its physical connection to the intake air conduit. By locating the liquid passageway 27 in the upper deck 23, the cooling air contacts the underside of the passageway 27 in the area above the exhaust and air intake conduits 2, 3 and the cooling air simultaneously flows around and along the exhaust conduit 2 so as to cool both the exhaust conduit and the oil in the liquid passageway 27.

Figure 6:
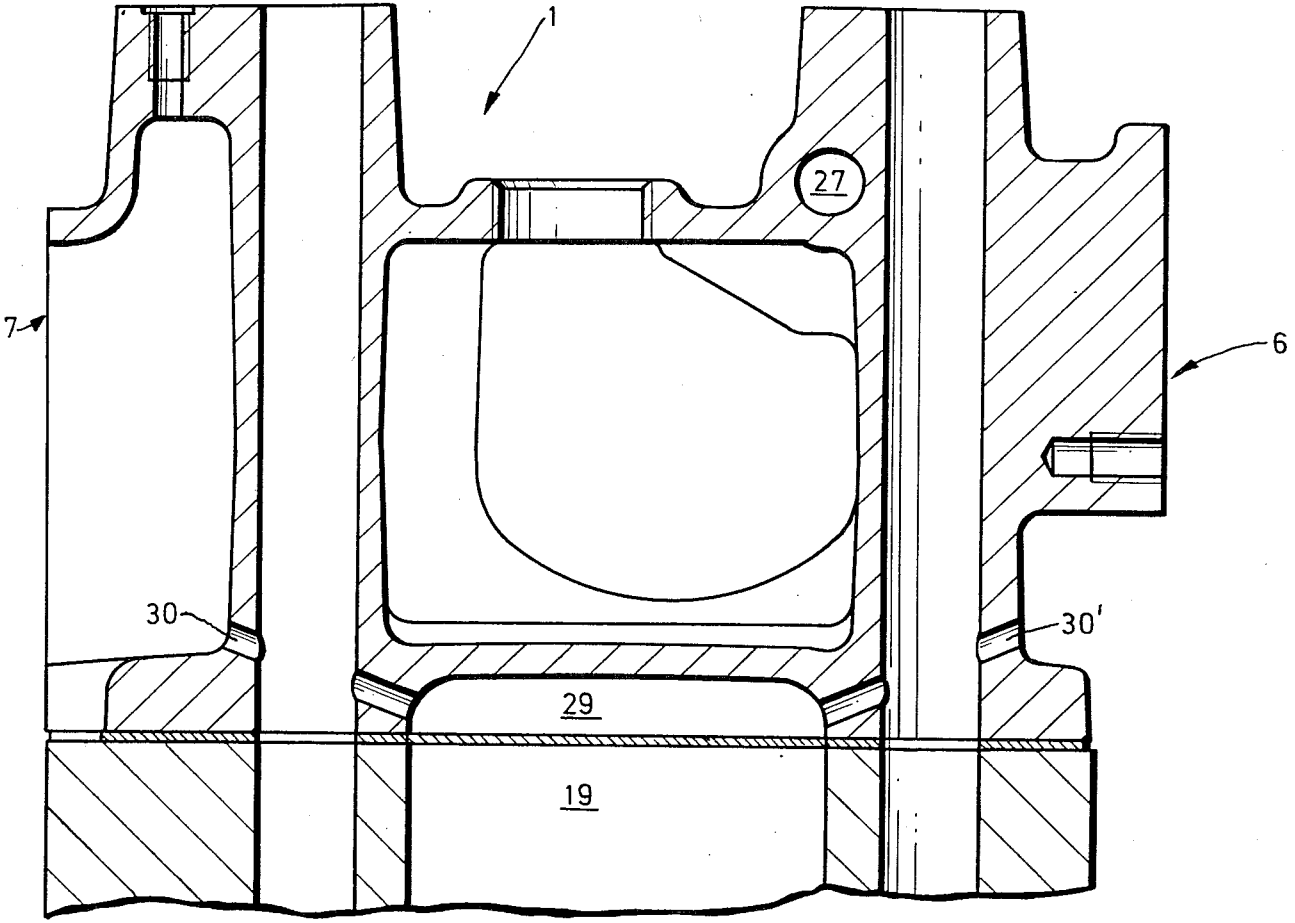
FIG. 6 is a vertical section through a cylinder head of the design shown in FIG. 5 in the area between two cylinders.
Figure 7:
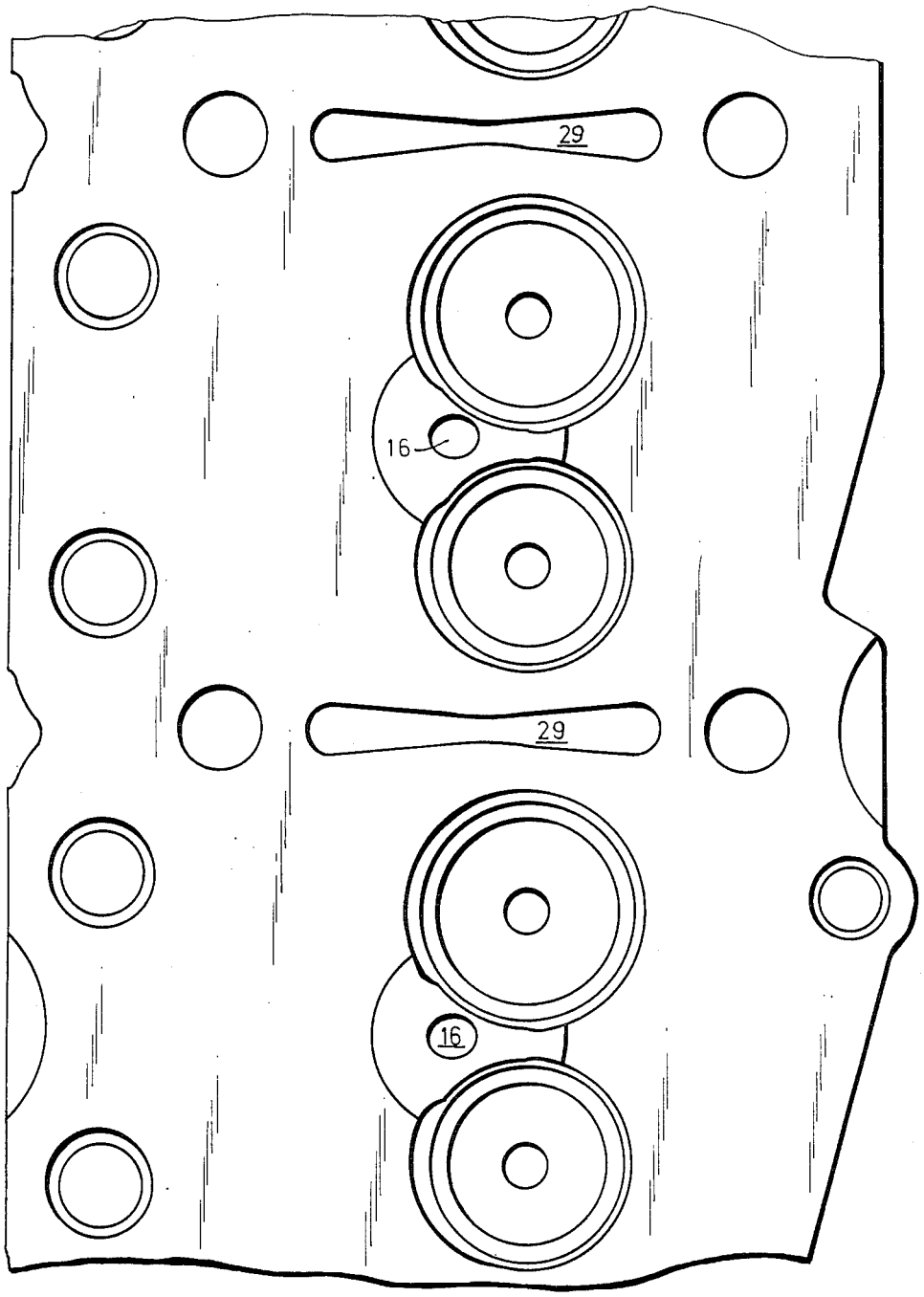
FIG. 7 is a bottom view of a cylinder head of the design shown in FIGS. 5 and 6.

As shown in FIGS. 6 and 7, a generally straight elongated slot 29 is formed in the underside of the cylinder head 1 in the area between two cylinder units and extending at a right angle to a plane through the axes 32 of the cylinders 18. In the design of FIG. 6, the slot 29 is bathed with cooling air via channels or bores 30, 30'. The channels 30, 30' are connected to opposite ends of the slot 29 and communicate with the laterally opposite sides 6, 7 of the cylinder head 1. The slots 29 may be bathed by cooling fluid rather than air. In such a design, a cylinder head gasket, not shown, has holes registering with the slots 29 so that the cooling liquid can pass from the cylinder cooling jacket chamber 19 into the slots 29 and the bores 30, 30' are not present.

The embodiments of the invention in which an exclusive property or privilege is claimed are defined as follows:

1. An internal combustion engine including a cylinder casing having a pair of in-line cylinders and an air-cooled cylinder head with a cooling air chamber and combustion chamber floors adapted to cover the ends of said cylinders, respectively, presenting an air intake valve port and an exhaust valve port for each of said cylinders, said floor having a flat combustion chamber side covering said ends of said cylinders and an opposite cooling chamber side, said cooling chamber side sloping in relation to said combustion chamber side presenting a smooth convex floor surface of spherical shape above each of said cylinders and sloping gradually in radial directions from the axis of the associated cylinder and a generally straight elongated slot in the said combustion chamber side of said head extending between and at a right angle to a plane through the axes of said cylinders.

2. The engine of claim 1 and further comprising an annular ridge on said cooling chamber side of said combustion chamber floor in surrounding relation to said floor surface.

3. The engine head of claim 2 and further comprising separate walls defining an air intake conduit and exhaust conduit and wherein said annular ridge is spaced from said walls defining said conduits by a cooling passageway.

4. The engine of claim 1 wherein said head includes an upper deck, vertically aligned cylinder head bolt openings in said upper deck and said combustion chamber floor wall, means defining an air intake conduit and an exhaust conduit, said air intake conduit including a vertically extending wall of crescent section interconnecting said combustion chamber floor and said upper deck and presenting an arcuate channel in general axial alignment with said aligned bolt openings.

5. The engine of claim 1 wherein said head includes an upper deck, support walls between said upper deck and said combustion chamber floor, walls defining air intake conduits connected to said air intake valve ports, respectively, and walls defining exhaust conduits connected to said exhaust valve ports, respectively, said conduits terminating at one lateral side of said head, an exhaust valve guide rigidly interconnecting said upper deck and each of said exhaust conduits, said walls defining said exhaust conduits being detached and separated from said support walls and from said walls defining said air intake conduits.

6. The engine intake conduit of claim 1 wherein said head includes an upper deck spaced above said combustion chamber floor, a cooling air guide fin on the underside of said upper deck presenting a downwardly sloping surface operative to guide cooling air downwardly toward said combustion chamber floor.

7. The engine of claim 1 wherein said head includes walls defining exhaust conduits with corresponding ends connected, respectively, to exhaust valve ports in said combustion chamber floor and terminating at their opposite corresponding ends in connector flanges adapted for connection to an exhaust manifold and air guide fins directing cooling air whereby cooling air flows around said walls defining said exhaust conduits and exits the head on all peripheral sides of said connector flanges.

8. The engine of claim 1 wherein said cylinder head includes passages connecting said cooling air chamber with opposite ends of said slot.

9. The engine of claim 1 wherein said head includes an upper deck, separate walls defining air intake and exhaust conduits connected, respectively, to said air intake and exhaust valve ports and terminating at one lateral side of said head, valve spring seats formed on the top side of said upper deck, wall means defining a liquid passageway in said upper deck extending the longitudinal length of said head at the height of said valve spring seats and spaced from the latter in the direction toward said one lateral side of said head, whereby the part of said wall means defining the portion of said liquid passage which extends longitudinally above said air intake and exhaust conduits is contacted by cooling air flowing laterally across said head between said conduits and said part of said wall means and exiting on said one lateral side of said head.

10. Air-cooled cylinder head of an internal combustion engine including a combustion chamber floor adapted to cover the end of an engine cylinder and presenting an air intake valve port and an exhaust valve port, said floor having a flat combustion chamber side and an opposite cooling chamber side, said cooling chamber side sloping in relation to said combustion chamber side from the central part of said combustion chamber floor to provide a smooth floor surface sloping gradually in radial directions from the axis of said cylinder, an upper deck in vertically spaced relation to said combustion chamber floor, support means extending vertically between said combustion chamber floor and said upper deck defining cooling air passageways extending laterally between opposite lateral sides of said cylinder head directing cooling air across said smooth floor surface in passing from one lateral side of said head to the other and walls defining an exhaust conduit connected to said combustion chamber floor only at said exhaust valve port and extending laterally to a manifold connector flange at one lateral side of said head, an exhaust valve stem support interconnecting said exhaust conduit and said upper deck at a location above said exhaust valve port, the part of said conduit extending laterally from said exhaust valve stem support being free of direct connection to other parts of said head.

11. The air-cooled cylinder head of claim 10 and further comprising walls defining an intake conduit connected to said combustion chamber floor at said intake valve port and extending laterally to a lateral side of said cylinder head free of connection to said exhaust conduit, said intake and exhaust conduits being generally aligned with the direction of cooling air flow through said cooling air passageways.

* * * * *

UNITED STATES PATENT OFFICE

CERTIFICATE OF CORRECTION

Patent No. 4,781,158 Dated November 1, 1988

Inventor(s) Lothar Bauer and Ernst-Siegfried Hartmann

It is certified that error appears in the above-identified patent and that said Letters Patent are hereby corrected as shown below:

Column 6, line 8, "an" should be inserted between "and" and "exhaust";

Column 6, line 33, delete "intake conduit";

Column 6, line 41, "said" should be inserted between "to" and "exhaust".

Signed and Sealed this

Seventh Day of March, 1989

*Attest:*

DONALD J. QUIGG

*Attesting Officer* *Commissioner of Patents and Trademarks*